US006105163A

United States Patent [19]

Edmiston

[11] Patent Number: 6,105,163

[45] Date of Patent: Aug. 22, 2000

[54] ARTICLE FOR WARMING AN APPENDAGE

[76] Inventor: Dale Ann Edmiston, P.O. Box 366, Beaver, Pa. 15009

[21] Appl. No.: 09/249,534

[22] Filed: Feb. 11, 1999

[51] Int. Cl.[7] ..... A41D 13/00; A61F 5/00

[52] U.S. Cl. ..... 2/22; 2/16; 602/23

[58] Field of Search ..... 2/455, 16, 59, 2/69, 22, 23, 24, 159, 161.1, 465; 602/23

[56] References Cited

U.S. PATENT DOCUMENTS

| | | | |
|---|---|---|---|
| 2,459,992 | 1/1949 | Cimino | 2/59 |
| 4,243,028 | 1/1981 | Puyana | 128/165 |
| 4,344,189 | 8/1982 | Futere et al. | 2/16 |
| 5,105,473 | 4/1992 | Valtakari | 2/227 |
| 5,173,967 | 12/1992 | Carter | 2/16 |
| 5,315,716 | 5/1994 | Baum | 2/227 |
| 5,372,575 | 12/1994 | Sebastian | 602/20 |
| 5,638,546 | 6/1997 | Vita | 2/16 |
| 5,647,062 | 7/1997 | Nigbur | 2/16 |
| 5,918,310 | 7/1999 | Farahany | 2/23 |

OTHER PUBLICATIONS

R.U. Outside, "Sports Tech's Thumb Thing Thumb and Wrist Support", p. 9, '98–'99.

*Primary Examiner*—John J. Calvert
*Assistant Examiner*—Tejash D Patel

[57] ABSTRACT

An article for warming an appendage, particularly an athlete during inclement weather when this athlete is taking a break from the playing field is provided. The article comprises a flexible material, such as cloth, having a predetermined size and shape capable of being wrapped about the appendage. This flexible material may be customized according to a particular team's colors and/or logo. The flexible material includes at least one pocket which can have inserted therein an insulating means. Provided on the flexible material is a fastening means, preferably a quick release fastening means such as Velcro® or snaps, for securing the article about the appendage in a manner that the article can be quickly and easily removed from the appendage. This invention has particularly utility in the field of soccer for warming the thighs of the soccer players and allows for the quick removal thereof when the players are called into the game.

20 Claims, 2 Drawing Sheets

ARTICLE FOR WARMING AN APPENDAGE

FIELD OF THE INVENTION

The present invention relates, in general, to an article for warming an appendage and, more particularly, this invention relates to an article for warming an appendage of an athlete during inclement weather when this athlete is taking a break from the playing field. This invention has particularly utility in the field of soccer for warming the thighs of the soccer players and allows for the quick removal thereof when the players are called into the game.

BACKGROUND OF THE INVENTION

As is generally well known, outdoor amateur sporting events are sometimes held during inclement weather. Specific types of events, such as soccer and track, require the participants to dress in lightweight clothing during competition. Oftentimes, these participants are removed from competition during rest periods, substitutions of other participants, and/or between races. During this down time, depending upon the weather, this participant can become cold while waiting to rejoin the competition. Also, the participant's muscles can become cold, resulting in the more serious problems of muscle pulls and strains. Oftentimes the participants try to keep warm by moving around during their rest period and holding the legs of their shorts closed. While it is well known that most participants have warm-up clothes, such as sweatpants and/or sweatshirts, oftentimes, the participant does not put these on because they have only a few seconds to remove them should they be called back into the competition. As a result, the participants do not put on their warm-up clothes but remain exposed to the elements while in a resting mode.

SUMMARY OF THE INVENTION

It is an object of the invention to provide an article which may be wrapped about an exposed appendage for warming this appendage.

It is a further object of the invention to provide an article which is capable of holding the legs of shorts closed for competing athletes during rest periods.

It is yet a further object of the invention to provide an article which is capable of keeping an athlete's muscles warm, such as the thigh muscles, during rest periods, resulting in less injuries to the athlete.

It is another object of the invention to provide an article which may be easily and quickly removed when the athlete or participant is called back into play.

It is still another object of the invention to provide an article which is adjustable according to size and severity of weather.

It is another object of the invention to provide an article which may be customized according to team colors and/or logos.

Briefly, and in accordance with the forgoing objects, the invention comprises an article for warming an appendage, such as a leg or arm, during inclement weather, comprising a flexible material, such as cloth, having a predetermined size and shape capable of being wrapped about the appendage. This flexible material may be customized according to a particular team's colors and/or logo. The flexible material includes at least one pocket which can have inserted therein an insulating means in the form of foam or wadding. An opening is provided in the flexible material so that this insulating means can be readily removed so that the article may be washed. Provided on the flexible material is a fastening means, preferably a quick release fastening means such as Velcro® or snaps, for securing the article about the appendage in a manner that the article can be quickly and easily removed from the appendage. Optionally, an additional pocket may be provided wherein a warming means, such as a chemically activated hand warmer, may be placed therein to provide additional warmth.

The present invention has particular utility in the field of soccer where participants are required to wear lightweight clothing, such as shorts, during play. During rest periods or replacement of certain players during the game, the players on the sidelines often become cold and try to keep warm by holding the legs of their shorts closed. The article of the present invention is designed to wrap about the players legs and hold the short legs closed. When the players are called back into the game, the article can be quickly removed within seconds and the player is ready to rejoin the competition.

Although a number of objects and advantages of the present invention have been described in some detail above, various additional objects and advantages of the warming article of the present invention will become more readily apparent to those persons who are skilled in the art from the following more detailed description of the invention, particularly, when such detailed description of the invention is taken in conjunction with both the attached drawing figures and with the appended claims.

DETAILED DESCRIPTION OF THE INVENTION

Figure 1A:
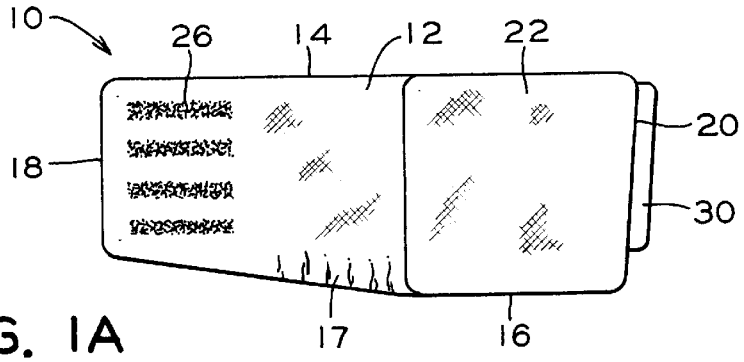
FIGS. 1A and 1B show an outside view of a left side configured and a right side configured warming article of the invention.
Figure 1B:
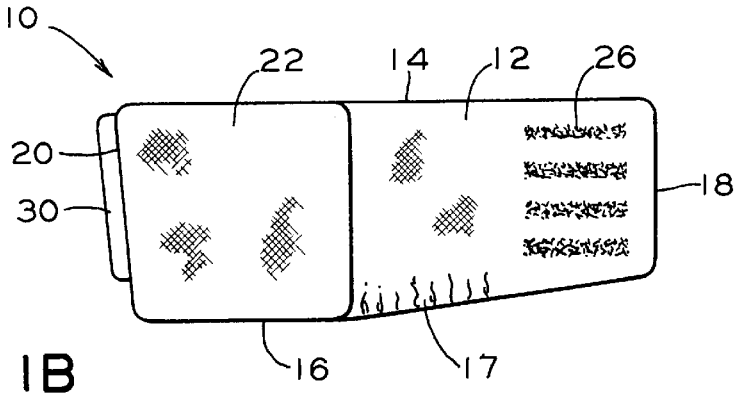
Figure 2A:
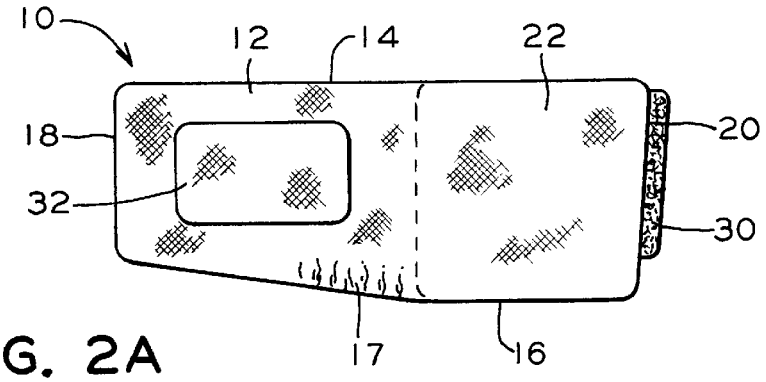
FIGS. 2A and 2B show an inside view of a left side configured and a right side configured warming article of the invention.
Figure 2B:
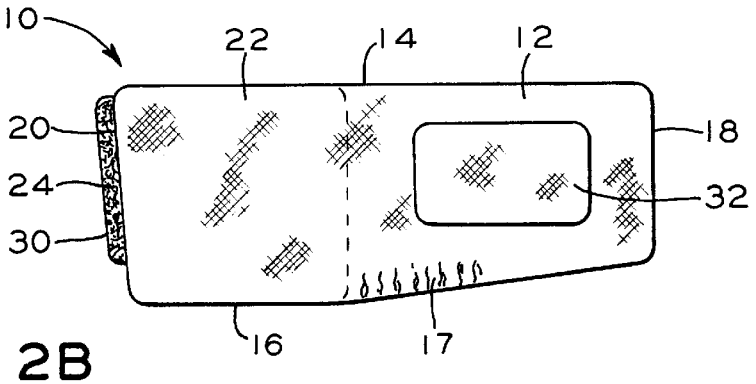
Figure 3A:
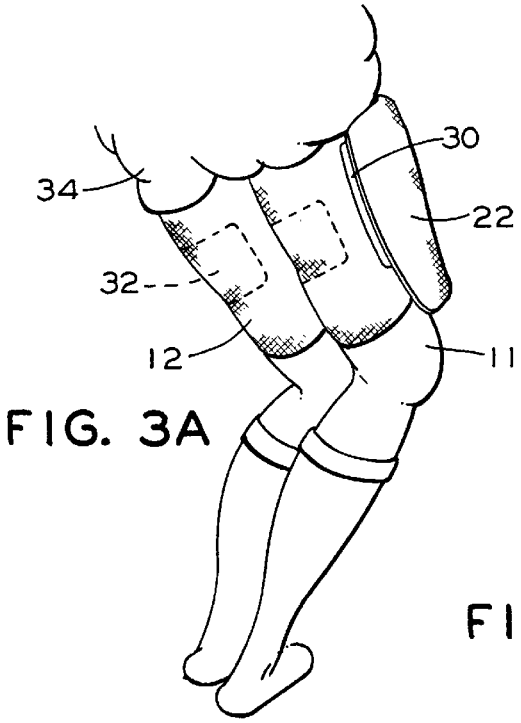
FIGS. 3A–3D show front, side, and rear views of the warming article of the invention wrapped about an appendage.
Figure 3C:
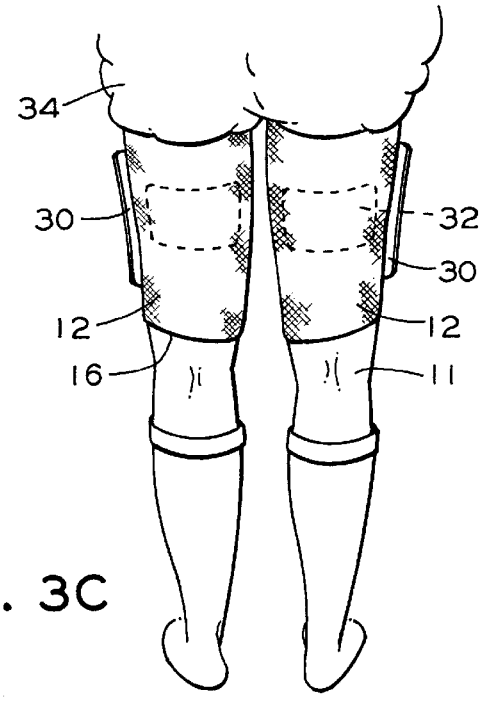
Figure 3B:
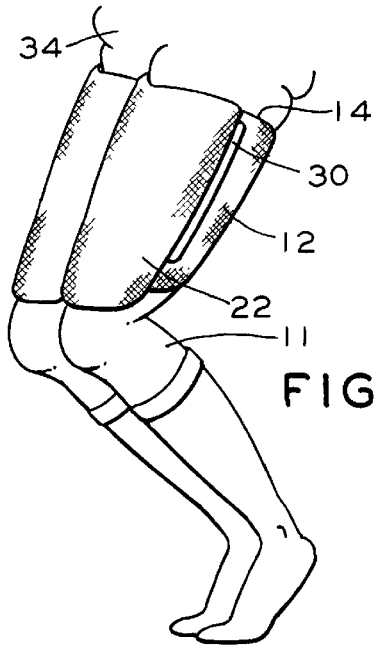
Figure 3D:
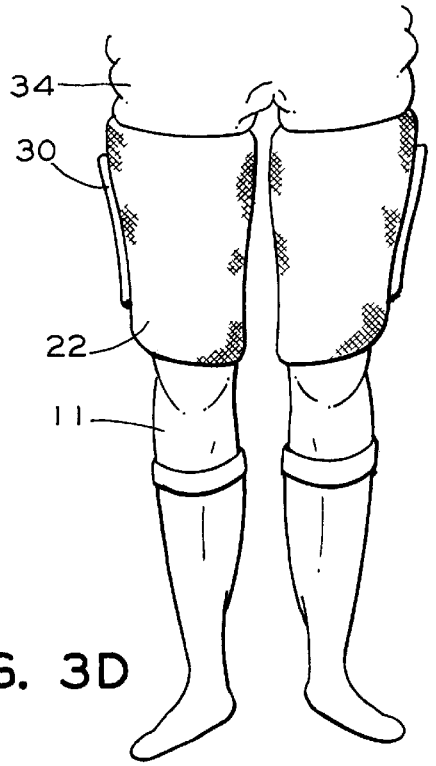

Prior to proceeding with the more detailed description of the present invention, it should be noted that for the sake of clarity, identical components which have identical functions have been identified with identical reference numerals throughout the several views illustrated in the attached drawing figures.

Referring to the Figures, there is shown an article, generally designated as 10 for warming an appendage 11. The article comprises a flexible material, such as a piece of cloth or fabric 12, having a predetermined size and configuration. The material 12 has top and bottom edges 14, 16, as well as side edges 18, 20. Any well known type of material may be used such as flannel, polyester, cotton blends, and the like and this material may be a stretchable or non-stretchable. The color of the material may be customized according to a particular team's colors and/or logos may be printed on the article. Gathers 17 may be optionally provided, such as along the bottom edge 16 or any other location, to allow the article to be fitted snugly about the appendage 11 of the wearer and to prevent air from entering underneath the article 10 and contacting the wearer.

The article 10 is usually formed of a double thickness material so that at least one pocket can be formed therein to enable an insulating means or pad 22 to be inserted between the layers. This insulated means can be formed of any well known material such as low density foam, wadding, wool and the like and may be formed of any desired thickness typically approximately ½"–1". An opening is provided along at least one edge of the double thickness cloth 12 so that the insulating means 22 may be readily removed during washing of the article 10.

A fastening means 24, 26 is provided for securing the article about the appendage. Preferably this fastening means comprises a quick release fastening means 24, 26 which allows for the quick removal of the article from said appendage such as Velcro®, snaps, and the like. A flap 30 can be formed integrally with or attached to the flexible material for providing a location upon which at least a portion of the quick release fastening means 24 may be attached. Manipulation of the quick release fastening means 24, 26 enables an adjustment of the size of the article so that the article may snuggle fit a variety of sizes of appendages 11. This adjustable manipulation may be achieved by the placement of a hook and loop fastener such as VELCRO® strips 26 positioned widthwise across a portion of the material so as to enable the size of the article 10 to be adjusted about the appendage 11.

Optionally at least one second pocket 32 may be provided adjacent to an inside surface of the material or the surface which will rest adjacent to the wearer's appendage. This second pocket 32 is of a size which is capable of receiving a warming means therein such as a commercially available chemically activated heating bags. A well known type of securing means, such as a hook and loop fastener commonly known as Velcro® or snaps (not shown) may be provided for closing this second pocket.

The present invention is particularly designed for use by soccer players in that it is capable of being placed around the thighs of the player such that the top portion of the article overlaps the bottom portion of the soccer players shorts 34 so as to hold the legs closed and prevent air from entering into the shorts when the player is waiting on the sidelines. When the player is called into the game, the quick release fastening means allow the article to be quickly and easily removed in a few seconds. The present invention could be used for other sports wherein the players wear lightweight clothing and the events take place in inclement weather such as track or lacrosse. Additionally, the present invention would be applicable for performers such as majorettes or cheerleaders who are also required to perform while wearing lightweight clothing oftentimes during inclement weather. Also, the present invention could be modified so that it may be wrapped about the arms of the players and/or performers if necessary.

Thus, the present invention has been described in such full, clear, concise and exact terms as to enable any person skilled in the art to which it pertains to make and use the same. It will be understood that variations, modifications, equivalents, and substitutions for components of the specifically described embodiments of the invention may be made by those skilled in the art without departing from the spirit and scope of the invention as set forth in the appended claims.

I claim:

1. An article for warming an appendage comprising:

(a) a flexible material having a predetermined size and shape and a first and second end, said flexible material capable of being wrapped about said appendage such that said first and second ends overlap one another;

(b) at least one pocket formed within said flexible material, said pocket including at least one opening;

(c) a removable insulating means insertable through said at least one opening of said at least one pocket;

(d) at least a second pocket placed adjacent to an outer surface of said flexibe material; and (e) a quick release fastening means having a first component secured to said first end of said flexible material and a second component secured to said second end of said flexible material for securing said article about said appendage in a manner such that said article may be quickly removed from said appendage.

2. An article as recited in claim 1, wherein said quick release fastening means comprises one of a hook and loop fastener and snaps.

3. An article as recited in claim 1, including a flap one of formed integrally with and attached to said flexible material, said flap providing a location upon which said fastening means may be attached.

4. An article as recited in claim 1, wherein manipulation of said fastening means enables an adjustment of the size of said article so that said article may fit a variety of sized appendages.

5. An article as recited in claim 4, wherein said fastening means comprises hook and loop fasteners positioned widthwise across a portion of said flexible material so as to enable the size of the article to be adjusted about the appendage.

6. An article as recited in claim 1, wherein said insulating means comprises one of foam and wadding.

7. An article as recited in claim 1, wherein said second pocket placed adjacent to an outer surface of said flexible material has a size capable of receiving a warming means therein.

8. An article as recited in claim 7, wherein said warming means comprises a chemically activated heating bag.

9. An article as recited in claim 7, including a securing means for closing said at least a second pocket.

10. An article as recited in claim 9, wherein said securing means comprises one of a hoop and loop fastener and snaps.

11. An article as recited in claim 1, wherein said flexible material comprises a cloth.

12. An article as recited in claim 11, wherein said cloth comprises one of flannel, polyester, and cotton blends.

13. An article as recited in claim 1, wherein said flexible material is capable of being customized according to a particular team's colors and/or logos.

14. An article as recited in claim 1, further including gathers along a bottom edge of said article for allowing the article to be fitted snugly about the appendage of a wearer.

15. An device for warming an appendage extending from an edge of an article of clothing comprising:

(a) a flexible material having a predetermined size and shape, a first and second end, and a top and bottom edge, said flexible material capable of being wrapped about said appendage such that said first and second ends overlap one another and said top edge of said flexible material overlaps such edge of such article of clothing;

(b) at least one pocket formed within said flexible material, said pocket including at least one opening;

(c) a removable insulating means insertable through said at least one opening of said at least one pocket;

(d) at least a second pocket placed adjacent to an outer surface of said flexible material; and (e) a quick release fastening means having a first component secured to said first end of said flexible material and a second component secured to said second end of said flexible material for securing said article about said appendage in a manner such that said article may be quickly removed from said appendage.

16. An article as recited in claim 15, wherein said at least a second pocket placed adjacent to an outer surface of said flexible material has a size capable of receiving a warming means therein.

17. An article as recited in claim 15, further including gathers along a bottom edge of said article for allowing the article to be fitted snugly about the appendage of a wearer.

18. An device for warming a persons's leg extending from an edge of an article of clothing comprising:

(a) a flexible material having a predetermined size and shape, a first and second end, and a top and bottom edge, said flexible material capable of being wrapped about said appendage such that said first and second ends overlap one another and said top edge of said flexible material overlaps such edge of such article of clothing;

(b) at least one pocket formed within said flexible material, said pocket including at least one opening;

(c) a removable insulating means insertable through said at least one opening of said at least one pocket;

(d) at least a second pocket placed adjacent to an outer surface of said flexible material;

(e) a removable warming means insertable within said second pocket; and (f) a quick release fastening means having a first component secured to said first end of said flexible material and a second component secured to said second end of said flexible material for securing said device about said appendage in a manner such that said device may be quickly removed from said persons's leg.

19. A device as recited in claim 18, further including gathers along a bottom edge of said device for allowing the device to be fitted snugly about the wearer's leg.

20. A device as recited in claim 18, wherein said removable warming means is a chemically activated heating bag.

* * * * *